United States Patent [19]

Jimerson

[11] Patent Number: 4,476,414

[45] Date of Patent: Oct. 9, 1984

[54] CAPACITOR BALLAST

[76] Inventor: Bruce D. Jimerson, 27375 Coolwater Ranch Rd., Valley Center, Calif. 92082

[21] Appl. No.: 445,444

[22] Filed: Nov. 29, 1982

[51] Int. Cl.[3] ..... H05B 37/00

[52] U.S. Cl. ..... 315/240; 315/DIG. 7

[58] Field of Search ..... 315/240, DIG. 7

[56] References Cited

U.S. PATENT DOCUMENTS 4,337,412 6/1982 Johnson ..... 315/DIG. 7

4,358,712 11/1982 Filgas et al. ..... 315/DIG. 7

*Primary Examiner*—Harold Dixon

[57] ABSTRACT

The specification discloses a capacitive ballast for operating a gas discharge lamp from a conventional low frequency power source. The effective restart voltage during each cycle is enhanced by a trigger capacitor or pulse transformer which functions to produce a short duration reignition current. Properly timed, the reduced lamp voltage caused by the injection of the reignition current will be approximately equal to the difference between the instantaneous potential of the power source at the time of reignition and the instantaneous magnitude of the voltage across the ballast capacitor. The proper magnitude of lamp current is thus re-established during each half cycle and thereafter sustained at a value which equals the rate of change of voltage across the ballast capacitor.

15 Claims, 20 Drawing Figures

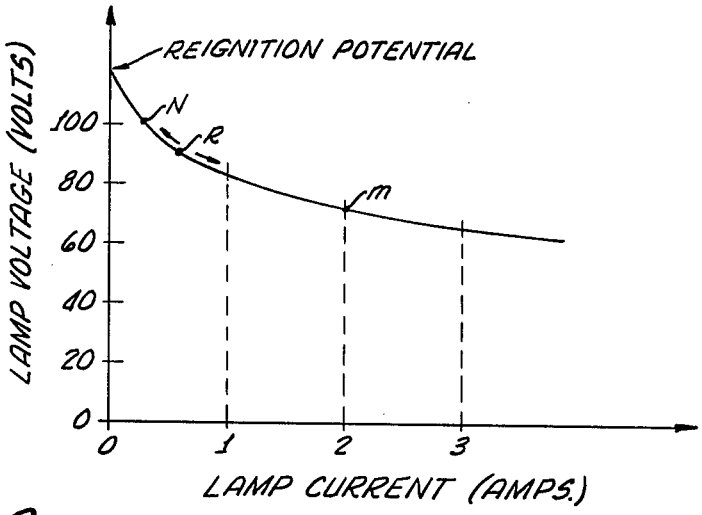
FIG. 3.
FIG. 4a.
FIG. 4b.
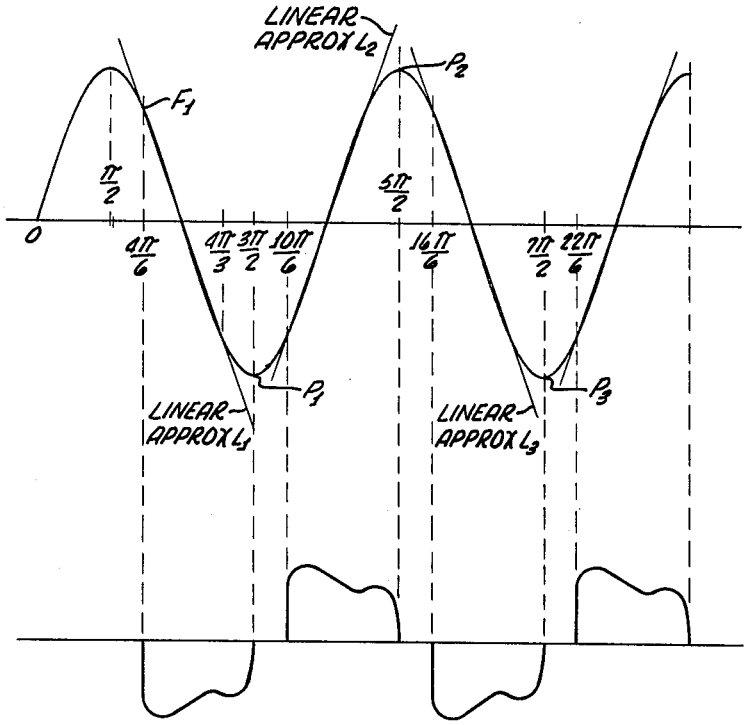

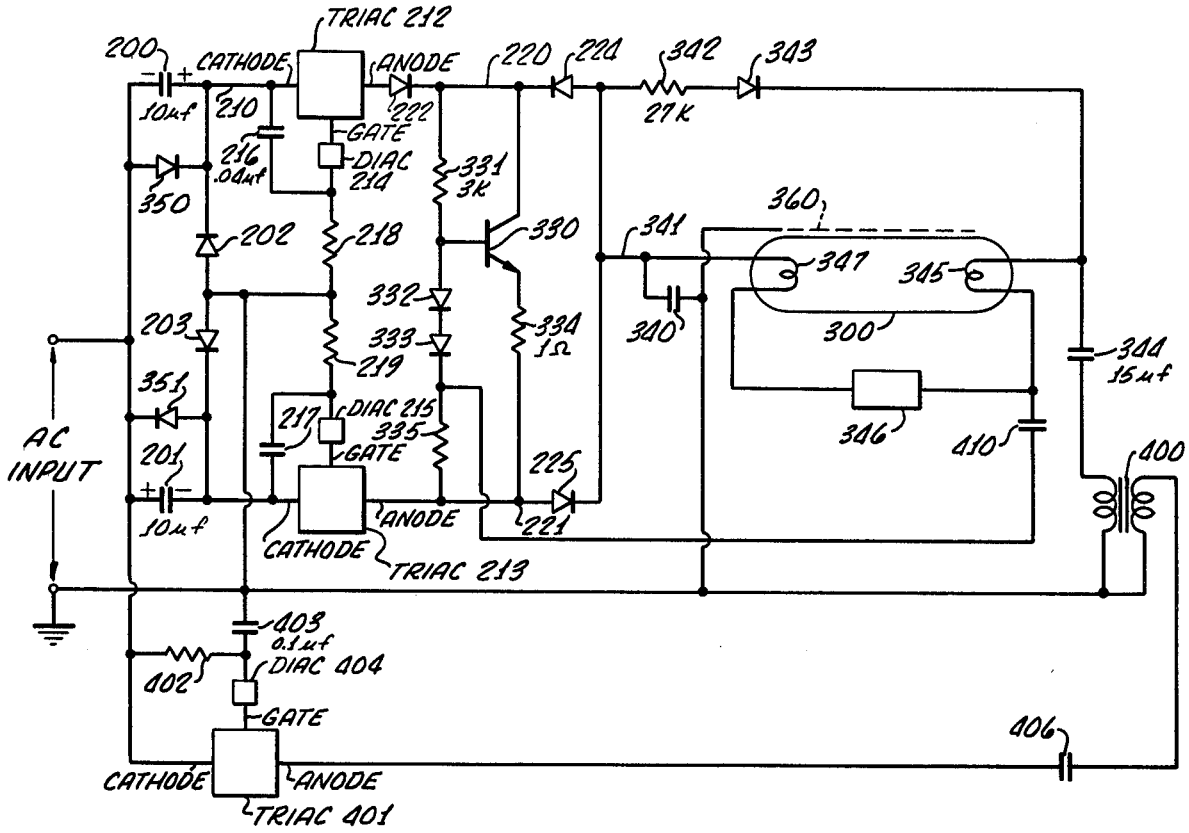
FIG. 10.
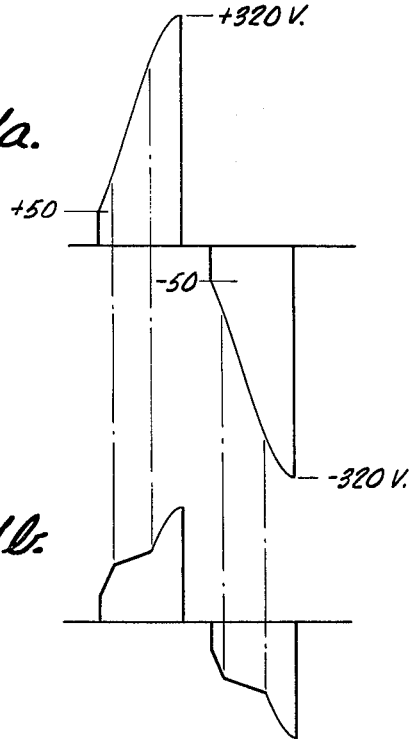
FIG. 11a.
FIG. 11b.

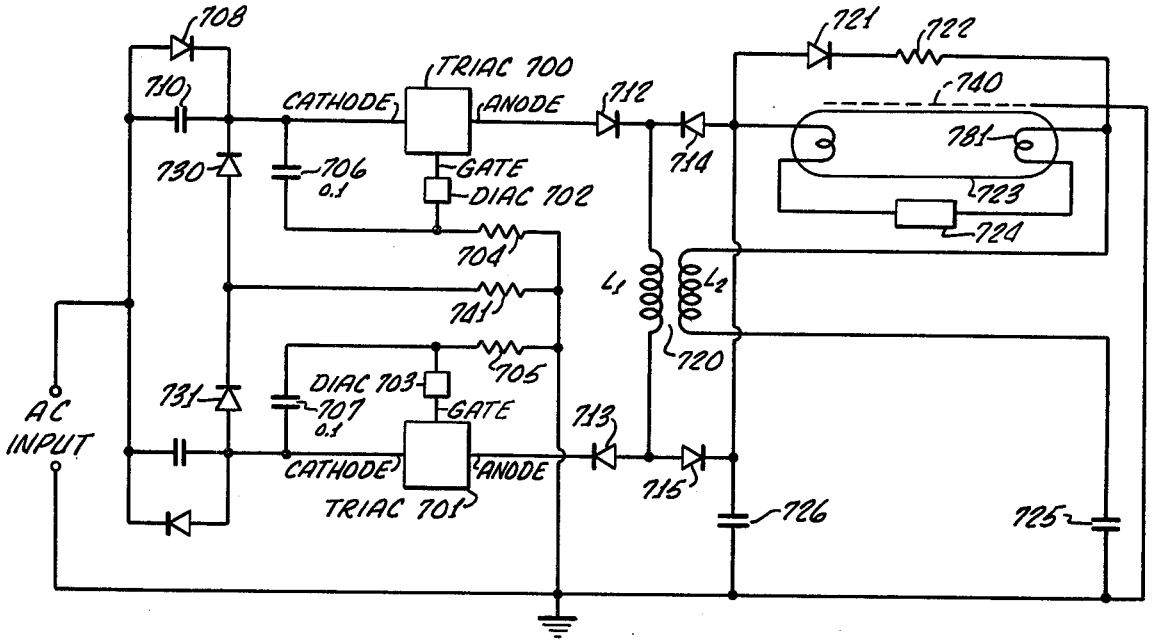
FIG. 12.
FIG. 13.
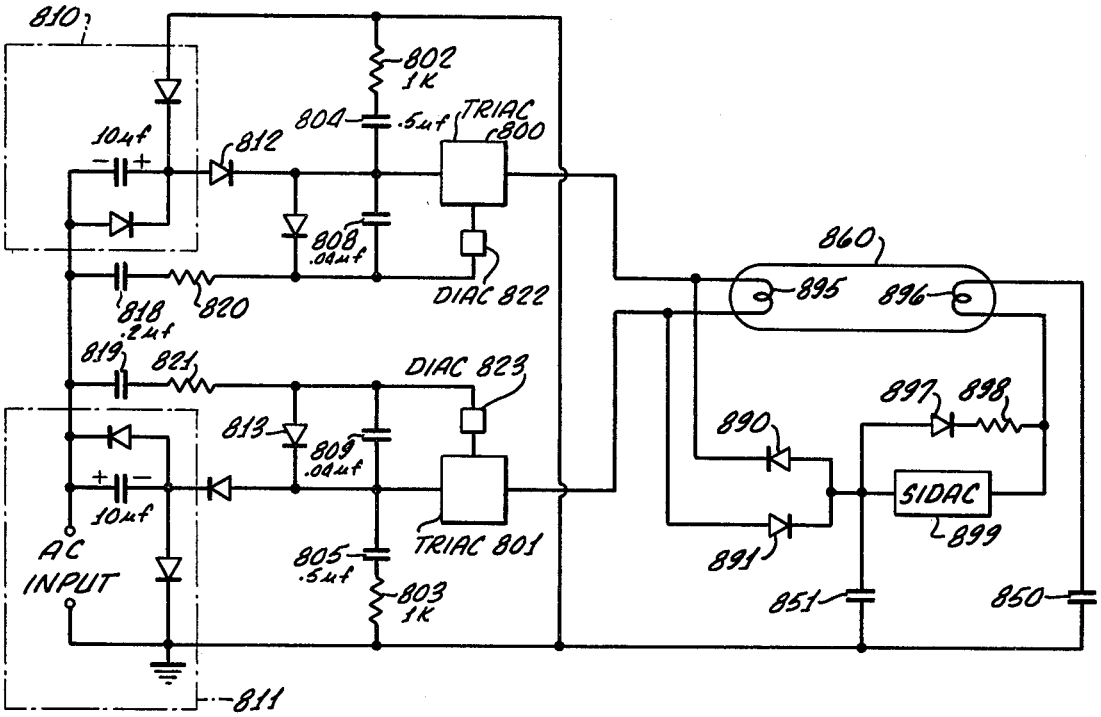

CAPACITOR BALLAST

CROSS REFERENCE TO RELATED APPLICATIONS

Reference is made to U.S. Pat. No. 4,117,377 entitled "Circuits for Starting and Operating Ionized Gas Lamps" by Henry H. Nakasone, Bruce D. Jimerson and Marvin Yim dated Sept. 26, 1978.

BACKGROUND OF THE INVENTION

The negative voltage-current characteristics of ionized gas lamps such as fluorescent, sodium vapor, neon, and others preclude the direct operation of such devices from D.C. or low frequency A.C. power sources. Once these devices are ionized, the voltage drop of the lamp decreases thereby allowing more current to be drawn. The increase in current further reduces the voltage drop across the lamp—the result being a rapid run away condition which destroys the lamp. Some means of limiting the current is therefore necessary to prevent this condition—while at the same time permitting sufficient current to operate the lamp at its desired operating point, i.e., that current which maximizes the ratio of the lumunous intensity relative to the power input.

Various arrangements of inductors, transformers, and resistors have been used to ballast gaseous discharge lamps. One of the most common devices is an autotransformer which steps up the input voltage and provides sufficient leakage inductance for limiting the current. These devices are heavy, bulky and expensive. In D.C. systems, a resistor is used in series with the lamp—but the power dissipation typically reduces the overall lamp ballast efficiency to approximately 50%.

More recently, high frequency transistor/transformer inverters have been utilized to reduce the physical size of the inductance, or to eliminate it entirely. Most of these ballasts produce a high voltage/high frequency square wave from rectified 60 cycle A.C. Alternatively, the inverter transformer may be eliminated by a voltage doubler and the output voltage therefrom can be chopped to produce the desired high frequency as taught in U.S. Pat. No. 4,117,377 referred to herein above. The generation of high frequencies, however, whether by means of a chopper or inverter, is somewhat costly in terms of the components required, and in the case of the inverter, additional filtering is required to reduce TVI and RFI in most industrial and household applications.

The use of capacitors as ballasts at a first glance appears ideal inasmuch as they dissipate little or no power and are generally smaller and less expensive than inductors and transformers. These characteristics can, in fact, be taken advantage of at high frequencies. Capacitors however, have not proved practical at low frequencies (e.g. 60 cps). A paramount reason for their inapplicability lies in the fact that the lamp must be restarted each half cycle when the AC current reverses. Since the reignition potential exceeds the operating voltage, the ballast capacitor will be abruptly discharged when ignition occurs. For example, if the current resistance is 10 ohms and the reignition potential of the lamp exceeds its operating voltage by 50 volts the discharge waveform of a series connected 10 $\mu$f capacitor is a pulse having a duration of 0.1 millisec and an amplitude of 5 amperes. Thus, pulse which occurs 120 times/sec for 60 cps power sources is short compared to the 16 millisec wavelength. As a consequence, the current flows in spikes which have a short duration and high magnitude. The light thus occurs in flashes, and the high current peaks cause rapid deterioration of cathode/filament electrodes. If sufficient series resistance is added to increase the discharge time and "smooth out" the current, considerable power will be dissipated in the resistor, and the overall lighting efficiency will be drastically reduced. What is actually desired is an arrangement which will take advantage of the low loss characteristics of a capacitor but which will permit a fluorescent or other ionized gas lamp to be properly operated from a standard low frequency power source.

Accordingly, a primary object of the present invention is to provide a simple inexpensive low-loss ballast for an ionized gas lamp.

A further object of the invention is to provide a capacitive arrangement for operating an ionized gas lamp from a standard 50 or 60 cps power source.

A further object of the invention is to provide a capacitive arrangement for effectively stepping up the 60 cps line voltage.

A further object of the invention is to provide an apparatus for starting and operating a fluorescent lamp which does not require an inductance to limit the current.

Another object of the invention is to provide a capacitive ballast which will operate from a standard household power source to provide a relatively smooth and continuous lamp current over a period which is equal to or greater than 50% of the input cycle.

Another object of the invention is to provide a low-loss ballast which does not require a chopper or inverter to raise the operating frequency of the voltage applied to the lamp.

A further object of the invention is to provide an arrangement for advancing the reignition point of a capacitor operated ionized gas lamp during each half cycle of the applied A.C. power source.

A further object of the invention is to provide a dual valued capacitance ballast having a low value at the time of ignition and a higher value during the remainder of the conduction phase.

A further object of the invention is to provide a first value of capacitance for reigniting a gas discharge lamp during each half cycle of the power source, and a 2nd value of capacitance for providing a relatively constant current during the conduction portion of each half cycle of the input wave form.

Another object of the invention is to provide an arrangement for ballasting an ionized gas lamp which will provide during each half cycle of the A.C. power source, an "off" interval for charging a striking capacitor, a first "on" state interval for discharging the striking capacitor so as to reduce the lamp voltage and initiate lamp current, and a second "on" state interval for maintaining the lamp current at a value equal to that which is produced by capacitatively differentiating the input voltage source.

Other objects and advantages of the invention will be obvious from the detailed description of a preferred embodiment given herein below.

SUMMARY OF THE INVENTION

The aforementioned objects are realized by the present invention which comprises a 1st capacitance having a value sufficient to produce a triggering current for reigniting a gas discharge lamp at a time subsequent to the occurrence of each positive and negative peak of the A.C. voltage source, a 2nd capacitance connected in series with said 1st capacitance and having a value sufficient to differentiate the A.C. voltage so as to maintain a continuous lamp current from the time of reignition until the slope of the A.C. input becomes zero, means for charging said 1st capacitance following a cessation of lamp current at zero slope so as to raise the aggregate voltage across said 1st and 2nd capacitance to a value which will effect early reignition of the lamp and, a means for shorting out said 1st capacitance after reignition takes place. The values of the 1st capacitance are preferable chosen such that the collapse of the voltage across the lamp at reignition will produce a discharge current in the 1st capacitance which is approximately equal to the value of the current produced by the rate of change of voltage across the 2nd capacitance at the time of reignition. Ideally, the 1st capacitance will be charged to a value equal to the difference between the lamp ignition potential and the lamp voltage which corresponds to a current equal to that produced by the rate of change of voltage across the 2nd capacitance at the time of reignition. Under such conditions, the decrease in the voltage across the 1st capacitance at reignition will be equal to the decrease in voltage across the lamp at reignition, and the power dissipated in external components will thus be negligible since the lamp can be brought to its operating point without any overvoltage or current spike. Following reignition, the current is limited to a value proportional to the rate of change of voltage across the 2nd capacitance. Alternatively, a small pulse transformer may be used in lieu of the 1st capacitance to provide a timed triggering current to reignite the lamp immediately following the occurence of each positive and negative peak.

DESCRIPTION OF THE DRAWINGS

FIG. 3 shows the relationship between current and voltage for a typical ionized gas lamp.

FIG. 4*a* illustrates the linear approximation to the slope of the sinusoidal input voltage waveform over a substantial portion of each cycle.

FIG. 4*b* shows the current waveform which results if a gas discharge lamp is reignited at the commencement of the linear slope portion of the waveform shown in FIG. 4*a*.

FIG. 10 shows a preferred embodiment of voltage doubling slope selecting ballast employing current limiting suitable for operating medium and high voltage lamps.

FIG. 11*a* shows for FIG. 10, the waveform produced across capacitor 340 prior to ignition.

FIG. 11*b* shows for FIG. 10 the waveforms produced across capacitor 340 during the operating phase.

FIG. 12 shows a modification and simplification of the voltage doubling slope switching configuration which produces reignition by virtue of the current pulse produced by the slope switching devices.

FIG. 13 shows an alternative arrangement for effecting slope switching preignition through the use of capacitors.

DETAILED DESCRIPTION OF THE INVENTION

Figure 1:
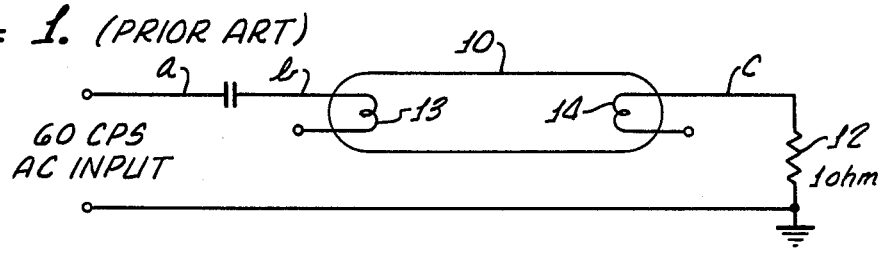
FIG. 1. (PRIOR ART)
FIG. 1 shows a simplified prior art capacitive ballast for operating an ionized gas lamp.
Figure 2A:
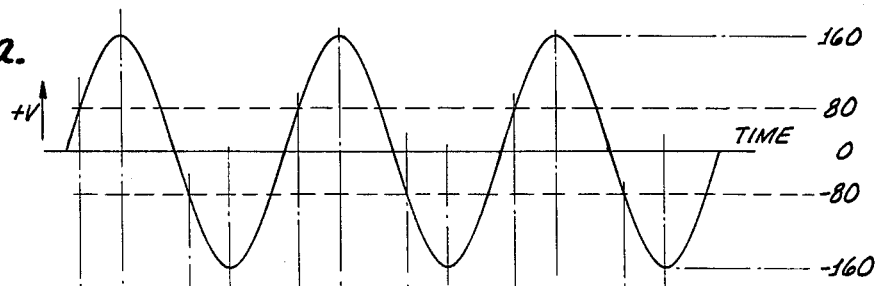
FIG. 2*a* shows for FIG. 1 the input voltage waveform as measured from point "a" to ground.
Figure 2B:
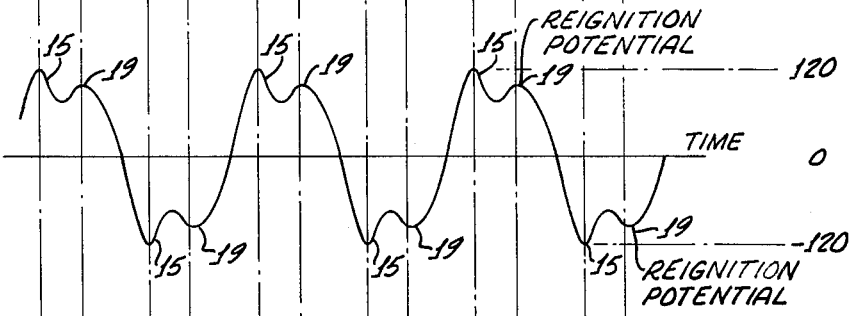
FIG. 2*b* shows for FIG. 1 the voltage waveform as measured from point "b" to ground.
Figure 2C:
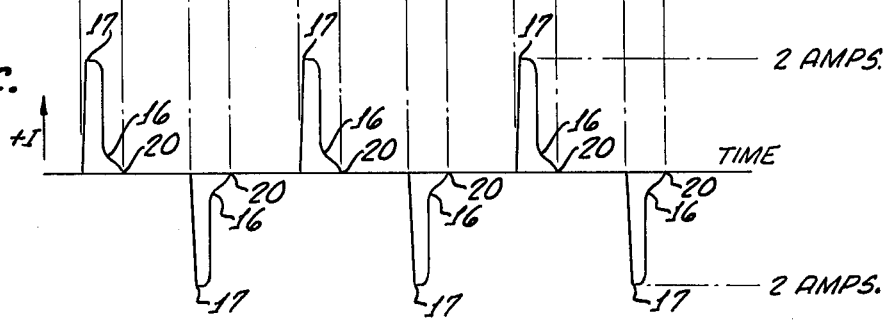
FIG. 2*c* shows for FIG. 1 the current waveform as measured by the voltage across the one ohm resistor at point "c" to ground.

Adverting to the drawings, and particularly FIG. 1 there is shown a simplified prior art arrangement for operating a gas discharge lamp 10 using a single series connected capacitance 11. The associated waveforms, namely the input voltage waveform as measured between point "a" and ground is shown in FIG. 2*a;* the voltage waveform across the lamp as measured from point "b" to ground is shown in FIG. 2*b;* the instantaneous current as measured by the voltage drop across the one ohm monitoring resistor 12 at point "c" is shown in FIG. 2*c;* and the negative resistance current-voltage characteristic of the lamp 10 is shown in FIG. 3. It will be assumed for purposes of explanation that the lamp has previously been started so that it will reliably reignite during each half cycle whenever the voltage across the electrodes 13 and 14 reaches the reignition potential.

The waveshape of the associated voltage and current waveforms shown in FIGS. 2*b* and 2*c* can be understood by reference to FIG. 3. During the nonconductive portion of each half cycle following a negative or positive peak of the input waveform shown in FIG. 2*a,* the voltage drop across the capacitor 11 remains constant so that the voltage waveform at "b" will have the same shape as the input waveform until the reignition potential is reached. Once ignition occurs, the current increases rapidly as shown in FIG. 2*c* to a maximum value limited only by the external impedance. Thus, if the external circuit impedance is small, the peak magnitude 17 of the current spike will be large, and the voltage across the lamp 10 will be abruptly reduced as indicated by dip 15 in waveform shown in FIG. 2*b* causing the lamp operating point to move to point "m" as indicated in FIG. 3. During the remainder of the conduction cycle, the current drops to a level corresponding to the rate of change of the input voltage as indicated by the value 16. At the conclusion of the conduction cycle, the "a" side of capacitor 11 will have a voltage magnitude equal to the peak value of the A-C, and the "b" side will have a magnitude equal to the voltage across the lamp 10 at the conclusion of the conduction cycle. During the next non-conductive portion of the input waveform, the difference in potential across the capacitor 10 is added to the input voltage at "a" so as to cause the lamp to reignite when the combined value (input waveform plus potential across capacitor 11) equals the reignition potential of the lamp 10, (i.e. 120 volt in the example illustrated). Following reignition the lamp voltage rapidly drops to 80 volts, with the 2 amp current peak being generated by the discharge of capacitor 11. When the current supplied by capacitor 11 is no longer of sufficient magnitude to maintain the lamp at the 80 volt-2 amp point "m", the operating point moves to point "n", and the voltage across the lamp rises to approximately 100 volts at a current of approximately 250 ma as indicated by the point 16. Thereafter the operating point moves further to the left until the end of the conduction cycle is reached—with the magnitude of the current during this period being dependent upon the time rate of change of voltage across capacitor 11.

From the foregoing description, it will be understandably advantageous to extend the duration of the current pulse and reduce its peak amplitude. As illustrated by the waveforms shown in FIG. 4*a*, the slope of the sine wave (60 cps input source) between the points $F_1$ and $P_1$, $F_2$ and $P_2$, $F_3$ and $P_3$, etc., can be approximated by straight lines ($L_1$, $L_2$ and $L_3$ respectively) with very little deviation over a substantial portion of the cycle. Stated mathematically, the derivative of a sine wave between $4\pi/6$ and $4\pi/3$ radians is a cosine wave whose normalized value varies from 0.5 to 1.0. Thus, during $2\pi/3$ radians of each half cycle the rate of change of voltage varies from a low of 0.5 to maximum 1. Since the current generated by a capacitor is given by $$I = C\frac{dV}{dt},$$

a capacitance can be used to provide a reasonably constant current source during those portions of each cycle which lie more than 30° from each negative and positive peak, i.e., that portion of each cycle where the slope of the input voltage is nearly constant as indicated by the straight lines $L_1$, $L_2$ and $L_3$. Thus, a 10 $\mu$f capacitor connected in series with 110 V RMS (A=160 volts peak) 60 cps ($\omega$=377 rad/sec) source will generate a current which varies between 0.3 amps at $2\pi/3$ radians to 0.6 amps at $\pi$ radians to 0.3 amps at $4\pi/3$ radians, in accordance with the following formula:

$$= C\frac{d}{dt}(A \sin \omega t)$$

$$(CA\omega) \operatorname{Cos} \omega t \Big|_{\pi}^{4\pi/6}_{4\pi/3}$$

In order to take advantage of such a current source it is necessary to provide a triggering mechanism which will bring the lamp to an operating point R (in FIG. 3) which correlates with the source current at the time reignition occurs. Moreover, the triggering mechanism should provide a short duration potential equal to the difference in voltage between the reignition potential and the lamp voltage at the operating point R. These objectives can be achieved through the use of a separate series connected trigger capacitor, or pulse transformer, which will induce a current equal to that produced by the time rate of change of input voltage across the ballast capacitor at the time reignition takes place. Under such conditions, the current waveform will be similar to that shown in FIG. 4*b*, the actual shape being dependent upon several factors which affect how the operating point "R" wanders along the E vs I curve of FIG. 4 during each half cycle as indicated by the arrows and as more fully discussed herein below.

Figure 5:
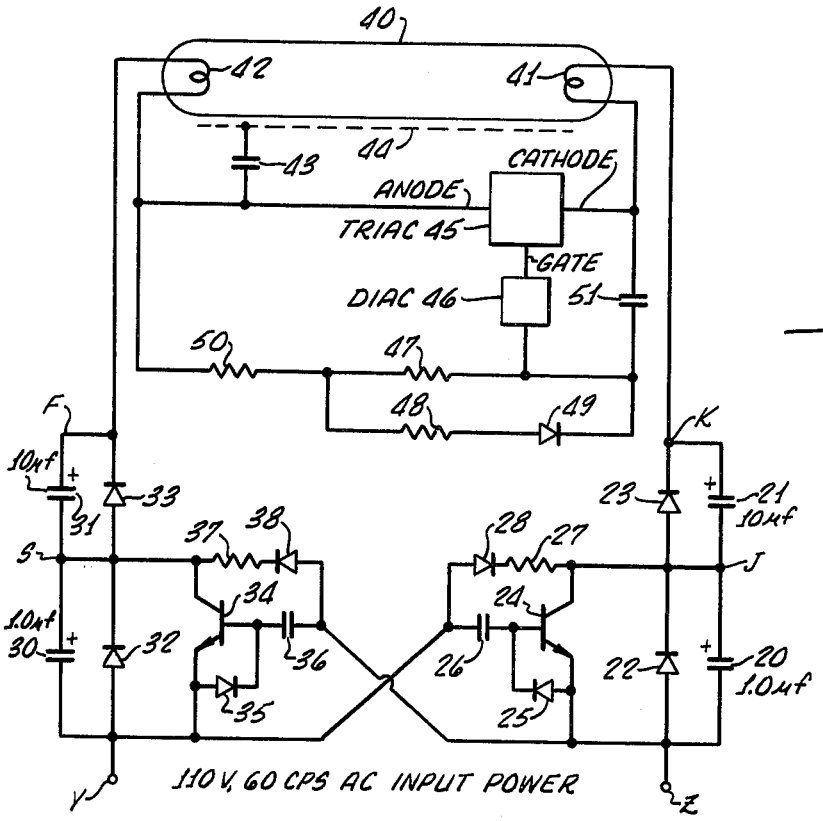
FIG. 5 shows a preferred embodiment of a transistor-capacitor ballast arrangement suitable for operating low wattage gas discharge lamps.

Referring now to FIG. 5, there is shown a first preferred embodiment of the invention which comprises a circuit composed of two identical halves—which operate in a reciprocal fashion during each half cycle of the input waveform. Thus, transistors 24 and 34 are preferably identical high Beta medium current devices, capacitors 20 and 30 are preferably 1 $\mu$f polarized capacitors, capacitors 21 and 31 are preferably 10 $\mu$f polarized capacitors, capacitors 26 and 36 are typically both of 0.5 $\mu$f non-polarized capacitors, and resistors 27 and 37 are preferably 1 watt, 4K ohms. Diodes 22, 23, 25 and 27 correspond to diodes 32, 33, 35 and 38 respectively—all preferably being rated at not less than 200 V reverse potential and not less than 3 amps average forward current. The remaining elements 43–51 are used only during the initial starting of the heated filament lamp 40 as more fully described below. For the purpose of simplyfing the description of operation, it will be assumed that lamp 40 has a characteristic similar to lamp 10 (FIG. 3) and that the filaments 41 and 42 have been heated by the action of triac 45, and that the initial starting operation has been completed. Since the ballasting arrangement is symmetrical, its operation can best be described by considering one input at ground potential. Thus, if the "Z" terminal is considered at zero, the potential at "F" will rise to maximum value of +160 volts when the A.C. input at "Y" reaches its positive peak (i.e., diodes 32 and 33 are forward biased). It will be assumed further that the lamp has been conducting during this part of the cycle, and that the capacitor 21 has charged to a potential equal to the difference between the voltage at "F" (160 V) and the voltage drop across the lamp 40 (for purposes of illustration 70 volts) so that the potential at "K" is thus 90 volts. There will be no charge on the capacitor 20 during this period, because the transistor 24 will be "ON" (i.e., in the conducting state) due to the positive base voltage produced by the capacitor 26 as a consequence of the rising input voltage at "Y". When the peak value of the A.C. is reached, the rate of change of the input voltage at "Y" is zero, and current ceases to flow in capacitor 21. Current also ceases to flow in transistor 24 since capacitor 26 is no longer able to supply base drive. When this occurs, the capacitor 20 begins to charge through diode 28 and resistor 27, thus raising the potential at point "K". The potential at point "K" continues to rise unti the voltage at "Y" decreases below the potential of capacitor 20. Thus, if the resistor 27 has a value of 4K, the initial charging current is thus 40 MA, and the potential at "J" will approach 40 volts in the first millisec following the peak of AC input at "Y". If the rising voltage at "J" reaches +50 volts at the time the decreasing potential at "Y" crosses 50 volts during its downswing, then the potential at "K" will reach a maximum of 140 volts. Assuming that the lamp reignition potential is 120 volts, conduction in the opposite direction will commence while the A.C. input voltage is still positive, i.e., at +20 volts. When this occurs, transistor 34 will be turned "ON" (conducting by virtue of the base current produced by capacitor 36 as a result of the decreasing voltage applied to the emitter of 34) so as to short out capacitor 30, and capacitor 20 will be immediately discharged to zero (through capacitor 21, lamp 40, capacitor 31 and transistor 34). Thus, if the time required to discharge the capacitor 20 is 0.2 millisec, the current through the lamp will have a magnitude of approximately 250 ma (I=C AV/AT) and the lamp will be brought to the 250 ma operating point at a time when the time varying input voltage is capable of producing a current of approximately 250 ma [$377\times160\times5\times10^{-6}$] as a result of the time rate of change of voltage across the two series capacitors 21 and 31. The 50 volt decrease in the circuit voltage resulting from the discharge of capacitor 21 will be approximately equal to the 30 volt difference between the lamp reignition potential (120 V) and the lamp potential which corresponds to the 250 ma operating point (100 V). If current limiting features are employed as described below with respect to FIG. 6, the excess voltage appears as a short duration spike on collector of the transistor 34—which contributes slightly to the power dissipated thereof.

Once conduction occurs, it will continue to be maintained by the time varying potential at Y—until such time that the negative voltage peak is reached. When this occurs, the elements associated with transistor 34 function in exactly the same manner to charge the capacitor 30 as the corresponding elements associated with transistor 24. For purposes of simplification, the point "Y" can be considered as grounded during the next portion of the cycle, and the point "Z" can be considered as being at the peak positive amplitude. Hence, as the base drive through capacitor 36 extinguishes, capacitor 30 commences charging through diode 38 and resistor 37 so as to raise the potential at "S" to 50 volts above the potential at "Y", leaving the potential at "F" equal to the sum of the voltages across capacitors 30 and 31, thus causing the lamp 40 to reignite when the decreasing potential at "Z" is still 20 volts positive with respect to "Y".

Figure 6:
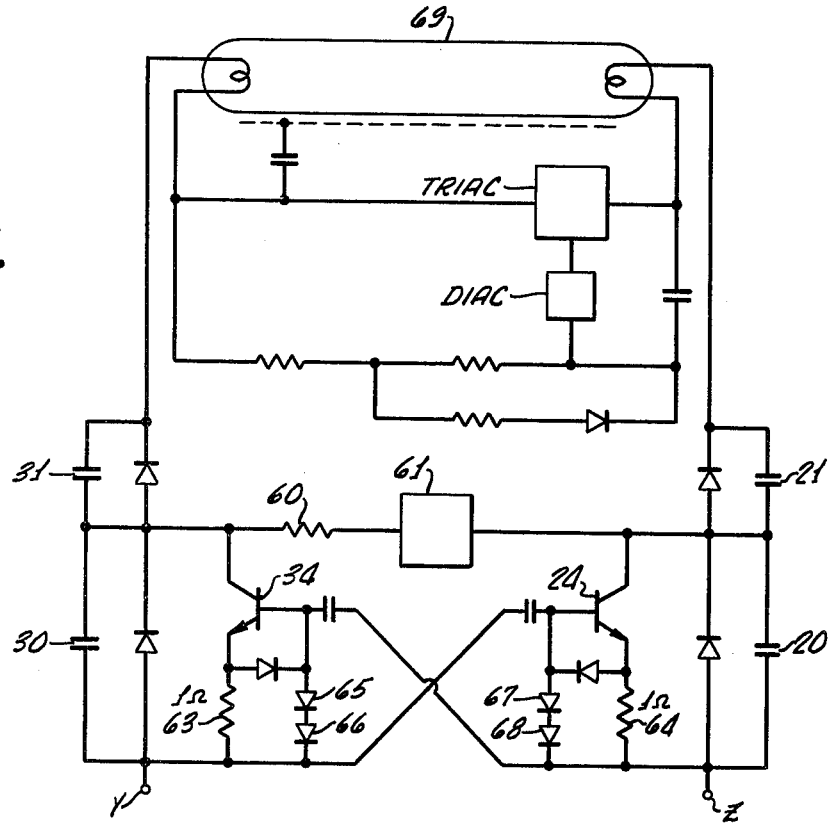
FIG. 6 shows an alternative preferred embodiment of a transistor-capacitor ballast employing current limiting.

FIG. 6 shows an alternative arrangement for charging the capacitors 20 and 30. The diode resistor arrangement of FIG. 5 (resistors 27 and 37 and diodes 28 and 38) are replaced by a single resistor 60 and Sidac 61 which is shown to have a firing voltage of approximately 145 volts. Thus, when the input voltage reaches ±145, Sidac 61 conducts so as to rapidly charge either capacitor from the opposite positive side of the input. Thus when "Y" is +145 volts with respect to "Z", Sidac 61 will conduct so as to cause current to flow through resistor 60. When the potential at terminal "Y" reaches its positive peak, transistor 24 stops conducting and the current flowing through 60 and 61 commences charging capacitor 20. Since current only flows after the Sidac 61 turns on, the value of resistor 60 can be decreased without increasing the overall power dissipation.

The starting circuit for the configuration shown in FIG. 5 and FIG. 6 comprises a triac 45, which is triggered into conduction by the discharge of capacitor 51 whenever diac 46 breaks down. Resistors 47, 48 and 50 are chosen so as to cause this event to occur at an earlier time during one polarity of the input waveform in order to increase the heating of filaments 41 and 42. Thus, during that portion of the cycle when "Y" goes positive capacitor 51 quickly charges through resistors 47, 48 and diode 49 to the breakdown potential of diac 46, causing triac 45 to conduct early in the cycle—whereas during that portion of the cycle when "Y" is going negative, diode 49 is back biased so that diac 46 does not break down until after the peak value of the source has passed. This delay increases the potential across the lamp 40 during ½ of the cycle which tends to enhance starting. Capacitor 43 couples the sharp change in anode potntial (which occurs when triac 45 conducts) to a conductor 44 which is spaced in close proximity to the surface of lamp 40 in order to induce preignition ionization to facilitate starting as more fully explained in the above identified prior art U.S. Pat. No. 4,117,377.

FIG. 6 also includes six additional components namely resistors 63 and 64 and diodes 65, 66, 67 and 68. These elements function to limit the maximum circuit current to approximately 0.7 amperes and are particularly useful when operating medium voltage lamps (e.g. 32 watts) where the reignition tends to occur later in the cycle (at a point near zero crossing), causing the intial current pulse to be somewhat larger.

Figure 7:
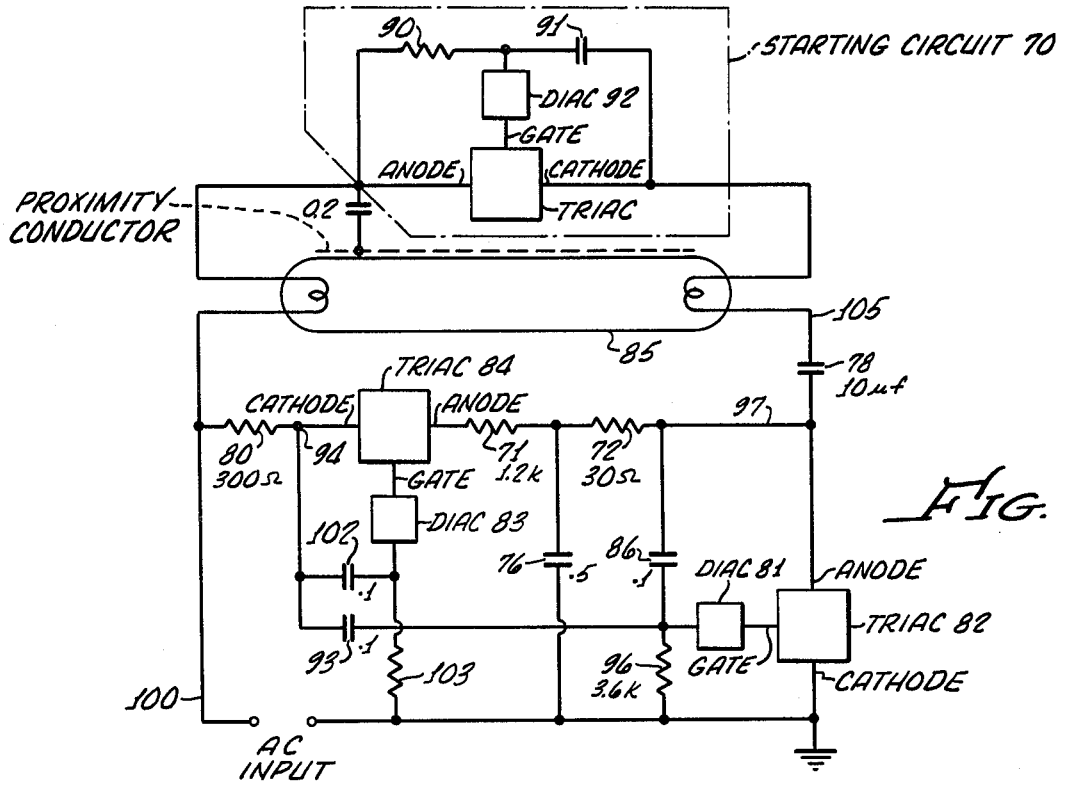
FIG. 7 shows a preferred embodiment of a capacitor ballast employing triacs to produce capacitive triggering to advance reignition.
Figures 8A, 8B, 8C, 8D:
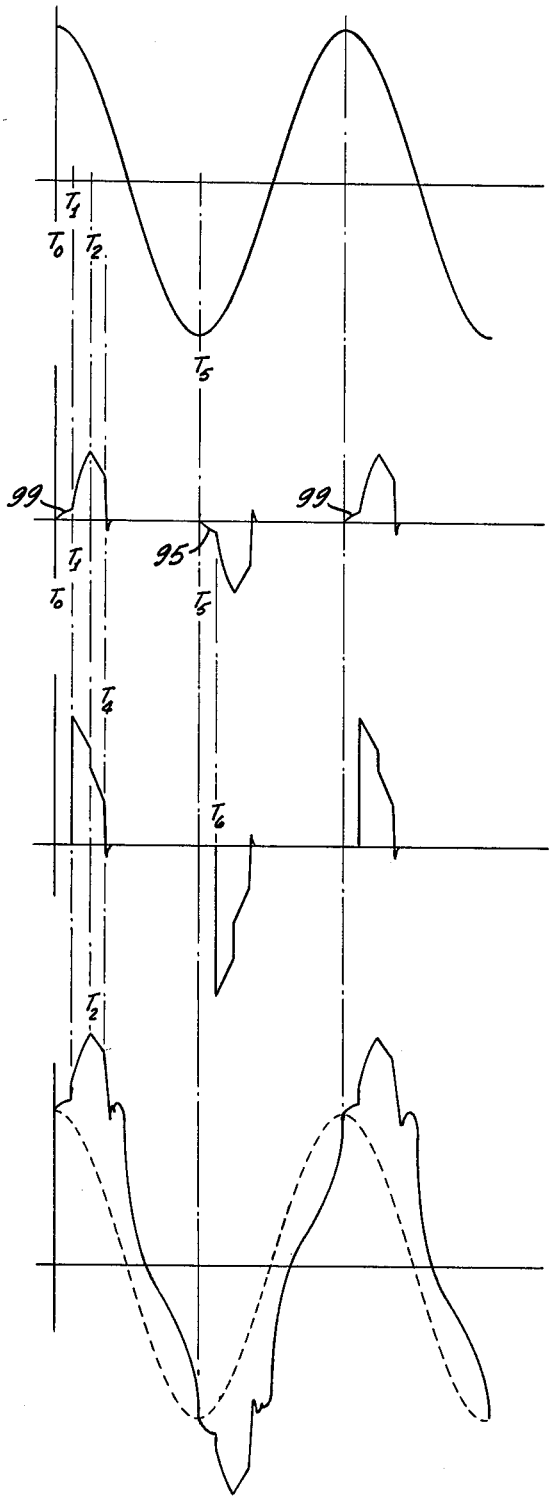
FIG. 8*a* shows for FIG. 7, the source voltage waveform as measured between the terminal 100 and ground.
FIG. 8*b* shows for FIG. 7, the voltage waveform as measured between point 97 and ground.
FIG. 8*c* shows for FIG. 7, the voltage waveform as measured between the anode of triac 84 and ground.
FIG. 8*d* shows for FIG. 7, the voltage waveform as measured between point 105 and ground.

FIG. 7 shows an alternative preferred embodiment which utilizes a single triac in lieu of the two transistor arrangement shown in FIGS. 5 and 6. In describing the operation of the circuit it will be assumed that the lamp 85 has been started by the operation of circuit 70, and that the resistor 90 and capacitor 91 are chosen such that diac 92 does not breakdown after the initial starting phase is completed (i.e., the reignition potential being less than the initial starting voltage, is not, during a time period of ½ cycle, sufficient to charge capacitor 91 to a potential which will breakdown diac 92.) It will also be assumed that the voltage at point 100 has reached its maximum positive potential, and that the capacitor 78 has been charged (by the current flowing through lamp 85) to its peak positive value during the conduction interval of the previous half cycle. As evidenced by the waveforms shown in FIGS. 8*a*–8*d*, triac 82 will cease conducting as the source voltage (FIG. 8*a*) reaches its peak so that any current still flowing in lamp 85 (between $T_0$ and $T_1$) will commence charging capacitor 76 positively (as indicated by numeral 99 of FIG. 8*b*). If the resistor 103 and capacitor 102 are chosen to trigger diac 83 so as to cause triac 84 to conduct at $T_1$, the waveform on the anode of triac 84 will appear as in FIG. 8*c* and the potential on capacitor 76 will rapidly charge through resistors 71 and 80 producing that portion of the waveform shown in FIG. 8*b* which occurs after the numeral 99—thus boosting the potential at point 105 by an equal amount, as shown in FIG. 8*d*. As shown in FIG. 8*c*, triac 84 ceases to conduct at time $T_2$—when the difference in potential between the voltage at point 100 and the potential on capacitor 76 is no longer sufficient to maintain the holding current. As the potential at point 100 continues to decrease to a point such that the algebraic potential difference across lamp 85 equals the lamp reignition potential, the lamp 85 will be triggered into conduction causing capacitor 76 to be rapidly discharged. The abrupt change at time $T_4$ in voltage at point 97 produces a corresponding change in the voltage across resistor 96 which triggers diac 81 causing triac 82 to conduct. Triac 82 will continue to conduct during the balance of the negative downswing and until such time that the rate of change of voltage across capacitor 78 is insufficient to maintain the minimum holding current. At this time ($T_5$) triac 82 switches "off" and capacitor 76 commences charging negatively as indicated by numeral 95 of FIG. 8*b*. Triac 84 then fires at $T_6$ and the cycle is carried out in the same manner as was described for the positive portion of the input waveform. As evidenced by the waveforms, the charging of a single capacitor 76 during the time triac 82 ceases to conduct, accomplishes the same objective as the two transistor circuits shown in FIGS. 5 and 6.

Unlike the transistor counterpart however, the triac 82 is easily prone to retrigger, and hence it is usually necessary to inject a neutralizing signal at the point between capacitor 86 and resistor 96 to prevent misfiring the triac 82 at the time triac 84 conducts. The polarity of the pulse at point 94 is opposite to that produced at point 97 and hence capacitor 93 may be chosen to provide a pulse of sufficient amplitude to neutralize the voltage pulse produced at point 97.

Experiments have shown that the starting characteristics of the circuit shown in FIG. 7 are superior to those of FIGS. 5 and 6. Accordingly, the starting circuit 70 may be used in lieu of the more complicated configuration shown in FIGS. 5 and 6. Alternatively, a single sidac may be used in place of the network 70 to effect reliable starting of 22 and 32 watt florescent lamps.

Figure 9:
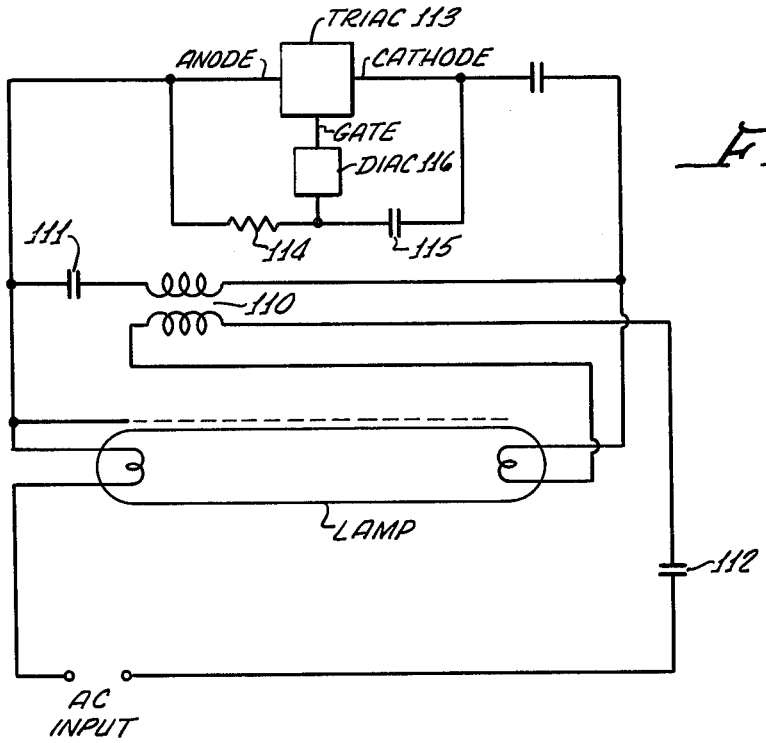
FIG. 9 shows an embodiment of a capacitor ballast in which preignition is achieved by a pulse transformer.

FIG. 9 shows an alternative means for injecting a triggering current to effect early reignition. Pulse transformer 110 has its primary winding connected in series with capacitance 111 which is discharged across the primary winding when triac 113 conducts. By adjusting the values of resistor 114 and capacitor 115, diac 116 can be caused to breakdown and fire triac 113 when the time rate of change of voltage across ballast capacitor 112 is sufficient to sustain the operating current at that point which corresponds to a lamp voltage equal to the difference between the instantaneous potential of the source and the potential across ballast capacitor 112. Thus, if capacitor 112 is charged to 100 volts, and the lamp voltage corresponding to ½ ampere current is 60 volts, resistor 114 and capacitor 115 should be chosen so as to trigger diac 116 (and hence triac 113) when the input voltage decreases to +40 volts. The value of capacitor 112 is preferably chosen so that it is sufficient to sustain the ½ ampere operating point as a result of the time rate of change of the input voltage at the 40 volt reignition point.

FIG. 10 illustrates an embodiment of the basic concept of the invention suitable for operating higher voltage lamps (e.g. 40 watt florescent). Considering first the state and functioning of the components prior to lamp ignition it will be seen that capacitors 200 and 201 operate as half wave voltage multipliers by virtue of the grounded diodes 202 and 203 respectively. Thus, when input terminal G swings negative, capacitor 200 is discharged through diode 202, whereas capacitor 201 is discharged via diode 203 during the positive half cycle. As a consequence, the sinusoidal waveform at point 210 is shifted positively by 160 volts whereas the waveform at 211 is shifted negatively by 160 volts.

Diac 214, capacitor 216 and resistor 218 are chosen to cause triac 212 to conduct when the cathode potential (point 210) reaches +50 volts. This conduction occurs therefore at the beginning of the positive slope so that point 218 jumps abruptly to 50 volts and then rises sinusoidally to a maximum positive potential of 320 volts. At this point, the slope of the input voltage waveform at G approaches zero causing triac 212 to switch off (i.e., the current flowing through capacitor 200 falls below the triac 212 holding current). During the negative half cycle resistor 219 and capacitor 217 cause diac 215 to conduct when the cathode potential at point 211 reaches −50 volts. When voltage at G reaches its negative maximum of −160 volts the potential at point 221 reaches its negative maximum of −320 volts. At this time, triac 213 switches off, and the cycle is repeated. Diodes 222, 223, 224 and 225 and the current limiting circuit comprised of transistor 330, diodes 332 and 333, resistors 334 and 331 function to algebraically sum the anode potential of triacs 212 and 213 across a single capacitor 340. Thus, prior to any current being drawn by the lamp 300, or its starting components, the voltage at point 341 will appear as shown in FIG. 11*a*. As evidenced by FIG. 11*a*, the waveform is functionally approximate to a bipolar sawtooth in that the slope of the positive and negative ramps are nearly linear over a wide percentage of each cycle. Resistor 342 and diode 343 provide an auxiliary path for charging capacitor 344 prior to ignition. As the charge builds up on 344, during each successive positive half cycle the effective starting voltage across the lamp 300 increases. Uninterrupted this potential will reach a maximum of 640 volts (+320 volts on filament 345 and −320 volts at point 341 when point G reaches its most negative potential). Prior thereto however, sidac 346 fires at ±450 volts causing current to flow through filament 345 and 347, thus discharging capacitors 201 and 344. When the peak negative value of the input at "G" is reached, capacitor 344 is charged through diode 351, triac 213, diode 223, resistor 334, transistor 330, diode 224, filament 347, sidac 346, and filament 345 to a potential of −160 volts. Thereafter, triac 213 ceases to conduct, and the input at G charges capacitor 200 positively so that capacitor 340 is raised to a positive potential of +290 volts when sidac 346 conducts in the opposite direction. When the input at "G" reaches its maximum positive potential of +160 volts, capacitor 344 will be charged to +160 volts via diode 350, triac 212, diode 222, transistor 330, resistor 334, diode 225, filament 347, sidac 346, and filament 345. The alternate charging and discharging of capacitor 344 during each successive half cycle of the input power source rapidly heats the filaments 347 and 345 to effectuate quick and reliable starting of lamp 300. As an additional aid, the fixture 360 may be connected to the ground side of the AC so that the sharp rise and fall of the waveform at 341 will induce preignition ionization as a consequence of the capacity between the lamp and fixture.

During the starting and quiescent operating phases, the waveform 341 is considerably altered. Following the starting phase, sidac 346 is inoperative since the lamp potential does not reach 450 volts, but the voltage on capacitors 200 and 201 will begin to deplete when the reignition potential is reached during each half cycle. Thus, if reignition occurs near the beginning of each change in the polarity of the voltage at 341, the voltage at 341 will increase at a relatively constant rate (as capacitor 344 discharges) until the voltage amplitude of the power source at "G" exceeds the potential at point 341. When this occurs, either diode 350 or 351 will be forward biased so the voltage at 341 will thereafer rise sinusoidally in accordance with the input power source at "G". FIG. 11*b* shows the theoretical waveform at point 341 during the steady state operating condition.

An important aspect of the configuration shown in FIG. 10 lies in the fact that the effective capacitance is increased near the end of the conduction cycle—at a time when the rate of change of voltage is decreasing. For example, if the operating potential across lamp 300 is 100 volts, and the voltage on capacitor 344 is zero when the input voltage at "G" is +100 volts, diode 350 will be forward biased during the remainer of the positive half cycle and the current will be proportional to the rate of change of input across capacitor 344. Conversely, during the first part of the positive conduction cycle, diode 350 is reversed biased and the higher rate of change of input voltage produces a current which is proportional to capacitor 200 and 344 in series.

Pulse transformer 400 functions to effect early triggering of lamp 300 at the time triac 401 conducts. For example, for a 40 watt florescent lamp having a reignition potential of 150 volts and an operating potential of 110 volts at ½ amperes, the maximum voltage swing on capacitor 344 will be ±50 volts during the operating phase. In the absence of a means for injecting a reignition current, lamp 300 will reignite when the voltage on capacitor 340 reaches ±100 volts. At the time of reignition, current is a maximum (700 ma) and the excess circuit voltage appears across transistor 330 resulting in considerable power dissipation. If however, resistor 402 and capacitor 403 are chosen so as to breakdown diac 404 when the voltage at point 341 is 60 volts, lamp 300 will be preignited. More specifically the conduction of triac 401 causes an abrupt change in the primary winding potential due to the discharge of capacitor 406—the result being a secondary winding voltage pulse of sufficient energy to reignite lamp 300. Since this occurs at a time when the circuit potential is equal to the lamp operating potential, there will be no excess voltage to dissipate power in the current limiting transistor 330.

The current limiting circuit comprised of transistor 330, resistor 331, diodes 332 and 333 and resistor 334 functions in two capacities—1st to limit the peak current flow in the lamp at reignition, and secondly, to limit the rate of change of voltage applied to the anodes of triacs 212 and 213. This latter function is sometimes necessary in order to prevent retriggering of the "off" triac due to the sharp voltage rise produced when the opposite triac "turns-on." The emitter resistor 334 is typically selected to determine the current limit value—preferably 700 ma. During starting, it is sometimes advantageous to disable the current limiting action so that more heat will be applied to the filaments. This is partially effected by capacitor 410 which induces a positive voltage across resistor 335 so as to raise the base potential when sidac 346 conducts. It will be understood however, that in some circuits, the current limiting features may not be necessary.

In certain cases, simplication of the circuitry is possible. For example, as shown in FIG. 12, the current limiter is deleted and a pulse transformer 720 is connected so as to generate a reignition voltage whenever either triac 700 or 701 conducts. More specifically, diode 708, capacitor 710 and diode 730 produce a waveform which rises sinusoidally from zero to plus 320 volts when the slope of the A.C. input is positive and diode 709, capacitor 711 and diode 731 produce a waveform which decreases sinusoidally from zero to minus 320 volts when the slope of A.C. input is negative. Capacitor 706, diac 702 and resistor 704 are chosen to trigger triac 700 when the instantaneous value of the input AC, less the potential on capacitor 725, is equal to the lamp voltage at the desired operating point. For example, if the voltage of the ionized gas lamp 723 is 100 volts at ½ ampere, then during the 1st negative half cycle following the ignition phase, capacitor 707, diac 703 and resistor 705 would cause triac 701 to conduct so that current flows through diode 713, the primary $L_1$ of pulse transformer 720, diode 714, lamp 723 and the secondary of pulse transformer $L_2$ so as to charge capacitor 725 to its maximum negative potential. If capacitor 725 is 15 μf and capacitor 711 is 10 μf, the voltage on capacitor 725 at the end of the negative conduction cycle will be approximately minus 60 volts. When the slope of input AC becomes zero, triac 701 will cease conduction, and capacitor 726 will be charged to minus 160 volts. When the input AC has reached minus 120 volts, the potential on the cathode of triac 700 will be +40 volts, and diac 702 will trigger triac 700 raising its anode to +40—thus discharging capacitor 726 through diodes 715 and 712 and the primary $L_1$ of pulse transformer 720. This change in the primary current of transformer 720 induces a 60 V pulse in the secondary $L_2$ which algebraically adds to the −60 V potential on capacitor 725 so as to produce a potential on the filament electrode 781 of −120 volts. If the magnitude of the reignition potential of lamp 723 is 160 volts, the lamp 723 will thus be triggered into conduction which continues during the remainder of the positive AC input slope charging capacitor 725 to a maximum of +60 volts. When the slope of the AC input commences to go negative, the components connected with triac 701 function in an analogous manner as those connected with triac 700—namely to cause triac 701 to fire when the AC input decreases to plus 120 volts, thus discharging capacitor 726 through diodes 714 and 713 and through the primary $L_1$ of pulse transformer 720 so as to reignite lamp 723 when the current reverses.

Resistor 741 is typically between 5 and 10 ohms. Its primary function is to prevent a short circuit should both triacs inadvertently be triggered "on" at the same time as the result of voltage spikes, or starting idiosyncrasies. Transformer 720 is preferably a small ferite core pulse transformer with primary and secondary windings of from 50 to 300 turns and resistances less than 2 ohms. The preferred turns ratio will depend upon the particular lamp characteristics and the operating voltage variations. Element 724 is preferably a 450 volt sidac, although any of the other starting circuits will suffice. Diode 721 and resistor 722 function to initiate the firing of sidac 724 after capacitor 725 has accumulated a sufficient potential.

FIG. 13 shows an alternative embodiment of the slope switching capacitor doubler wherein the transformer 720 is replaced by capacitors 804 and 805 each of which is connected through a current-limiting resistor 802 and 803 respectively to the cathode terminal of analogous triacs 800 and 801. The cathode of each triac 800 and 801 is coupled to its respective diode-capacitor voltage multiplier 810 and 811 by a diode 812 and 813 respectively. Thus, at the conclusion of the positive AC input slope, the capacitor 804 will be charged to plus 160 volts, and at the conclusion of the negative AC input slope capacitor 805 will be charged to minus 160 volts. The components comprising capacitor 818, resistor 820, capacitor 808 and diac 822 are chosen to trigger triac 800 into conduction during the positive slope of AC input at a time when the difference in voltage between the anode of diode 812 and the potential on capacitor 850 is equal to the desired operating voltage of lamp 860. Similarly, the components comprised of capacitor 819, resistor 821, capacitor 809 and diac 823 are chosen to trigger triac 801 into conduction during the negative slope of the AC input at a time when the difference in voltage between the cathode of diode 813 and the potential on capacitor 850 is equal to the desired operating voltage of lamp 860.

To illustrate further the operation of the circuit shown in FIG. 13, it will be assumed that the starting phase is complete, and that during a previous negative peak, capacitor 805 was charged to −160 volts and that lamp 860 has thereafter conducted during the duration of the positive AC input slope. When the peak positive AC input is reached, the voltage drop across lamp 860 will be 100 volts and capacitor 850 will be charged to +60 volts, capacitors 804 and 851 will be charged to +160. Immediately thereafter triac 800 will cease conducting and the slope of the AC input will become negative so as to commence charging capacitor 809 through resistor 821. When the potential on the cathode of diode 813 is −40 volts, the voltage on capacitor 809 will be sufficient to breakdown diac 823 causing triac 801 to conduct so that the stored charge on capacitor 805 discharges capacitor 851 through diode 890. Capacitor 851 is thus charged to a potential of −100 volts in a time determined by the values of capacitors 805, 851 and resistor 803. The −100 volt charge on capacitor 851 results in a potential difference of 160 volts between the filament 895 and 896 of lamp 860—causing lamp 860 to reignite. The current flowing through lamp 860 quickly recharges both capacitance 851 and 805 to −40 volts. Since this corresponds to the instantaneous value of the voltage on the cathode of diode 813, the lamp 860 will be brought to its desired operating point of 100 volts.

The use of the two diodes 890 and 891 reduce the possibility of short circuiting if one of the triacs (either 800 or 801) is triggered "ON" at a time when the other triac is conducting. The diode 897 and resistor 898 function to enable initial triggering of sidac 899 as previously explained hereinabove with respect to the circuit shown in FIG. 12.

Although the circuits have been discussed with little emphases upon component values, it will be understood that the choice of values is not unlimited. Thus, where the ballast capacitor is large, the voltage drop during a given time may be small compared to the change in voltage across the lamp at the recommended maximum operating current. For example if, for a particular ionized gas lamp, the time required for a 2 ampere increase in current from a desired operating point is 0.2 millisec, and the corresponding decrease in voltage is 40 volts, then the maximum circuit capacitance to prevent runaway is:

$$C \leqq I \frac{\Delta T}{\Delta V}$$

$$C \leqq 10\ \mu f$$

Hence, if it is desired to operate the lamp with a larger ballast capacitor, a current limiter (such as the type shown in FIG. 10) will be required. Similarly, a current limiter may be necessary in order to prevent premature extinction. For example, a gas lamp operated at 0.5 amperes will require a minimum input slope equal to the maximum rate at which the lamp voltage changes when the biasing point moves. Thus, if the time required for the lamp current to decrease from 0.5 to 0.1 amperes is 0.4 millisec, and the change in lamp voltage is 10 volts, then; the rate lamp rate $\Delta V/\Delta t$ is:

$$\frac{\Delta V}{\Delta t_L} = \frac{10 \text{ volts}}{0.4 \times 10^{-3}} = 25 \times 10^3 \text{ volts/sec}$$

For 110 V 60 cps source, the maximum source rate $\Delta V/\Delta t_S$ is:

$$\frac{\Delta V}{\Delta t_S} = \frac{d}{dt}(160 \text{ Sin } \omega t) = (160)(377) = 60{,}320 \text{ volts/sec}$$

Hence the circuit will not be prone to pre-extinguish except near the end of the conduction cycle—when the rate of change of input voltage falls below $25 \times 10^3$ volts/sec. From the foregoing it will be understood that in the absence of a current limiter the operating point will wander as the cycle progresses. Thus, as the rate of change of input source increases, the increased voltage produces an increase in current which causes the ballast capacitor to discharge more rapidly until the rate of change of voltage across the ballast capacitor is no longer able to support the increased current. The lamp current then begins to decrease rapidly until the circuit voltage produced by the change in input voltage "catches up" to the higher lamp voltage which corresponds to the reduced current supplied by the new rate of change of voltage across the ballast capacitor.

Although the basic concept of the invention has been shown and described in connection with particular embodiments, it will be understood that the invention is not limited htereto, and that numerous changes, modifications, and substitutions may be made without departing from the spirt of the invention.

What is claimed is:

1. An apparatus for operating an ionized gas lamp of the type having heated filament electrodes from a standard 50 or 60 cps alternating current power source comprising:

a ballast capacitor;

means for connecting said ballast capacitor in series with the lamp and power source;

means for reigniting the ionized gas lamp during each positive and negative half cycle of the alternating current power source at a time prior to zero crossing.

2. The apparatus recited in claim 1 wherein said means for reigniting the ionized gas lamp during each positive and negative half cycle of the alternating current power source at a time prior to zero crossing comprises:

a trigger capacitor connected in series with said ballast capacitor, ionized gas lamp and power source;

means for charging said trigger capacitor so as to increase the voltage across the ionized gas lamp prior to reignition;

means for short circuiting said trigger capacitor after the gas lamp is reignited whereby the current flowing in the lamp will be independent of said trigger capacitor.

3. The apparatus recited in claim 2 wherein said ballast capacitor has a value at least twice that of said trigger capacitor.

4. The apparatus recited in claim 1 wherein said means for reigniting the ionized gas lamp during each positive and negative half cycle of the alternating current power source at a time prior to zero crossing comprises:

a pulse transformer having a secondary winding connected in series with said ballast capacitor, ionized gas lamp and power source;

switching means connected to the primary of said pulse transformer for inducing a voltage pulse in said secondary winding during that period of time relative to the AC power source voltage which is subsequent to the occurance of a positive or negative peak, and prior to the time the AC power source voltage crosses through zero, voltage means connected to said switching means for producing a secondary voltage polarity which, when algebraically added to the voltage across said ballast capacitor, will inhance the magnitude of the potential across the lamp prior to reignition.

5. The apparatus recited in claim 4 wherein said switching means comprises a bistable semiconductor device.

6. The apparatus recited in claim 5 wherein said bistable semiconductor device is connected so as to have its main terminals in parallel across the electrodes of the lamp.

7. The apparatus recited in claim 1 wherein said means for reigniting the ionized gas lamp comprises:

temporary energy storage means for providing a voltage pulse of a polarity which algebraically adds to the potential across the ionized gas lamp immediately prior to reignition but not thereafter, whereby the current flowing in the ionized gas lamp following reignition is independent of said temporary energy storage means, and wherein said current following reignition is determined by the time rate of change of voltage across said ballast capacitor.

8. The apparatus recited in claim 7 wherein said temporary energy storage means comprises a capacitor having a value not greater than 50% of the value of said ballast capacitor.

9. The apparatus recited in claim 7 wherein said temporary energy storage means comprises a pulse transformer having its secondary connected in series with said ballast capacitor, gas lamp and AC power source.

10. A ballast arrangement for operating a two electrode gas discharge lamp from a standard A.C. power source comprising:

ballast capacitor means for producing a current which is proportional to the time rate of change of voltage of the A.C. power source;

trigger means for reigniting the gas discharge lamp at the commencement of each positive and negative slope of the power source;

circuit means for connecting said ballast capacitor means and said trigger means in series with the A.C. power source and gas discharge lamp.

11. The apparatus recited in claim 10 wherein said trigger means comprises:

switching means for momentarily increasing the potential across the gas discharge lamp;

sensing means for determining the instantaneous magnitude of the power source;

means responsive to said sensing means, and connected thereto, so as to operate said switching means at a time such that the algebraic sum of said ballast capacitor voltage and power source voltage will correspond to the gas discharge lamp operating voltage.

12. The apparatus recited in claim 10 wherein is included:

first circuit means connected to said power source for producing a positive voltage ramp having a time varying slope equal to the time varying slope of the input A.C. power source during that period of time which occurs between the nadir and positive peaks of the input power source;

second circuit means connected to said A.C. power source for producing a negative voltage ramp having a time varying slope equal to the time varying slope of the input power source during that period of time which occurs between the positive peak and the nadir of the input power source;

switching means connected to said first and second circuit means for selecting the output from either of said first or second circuit means and;

control means for actuating said switching means so as to cause said switching means to select the positive voltage ramp during the positive slope of the A.C. power source and the negative voltage ramp during the negative slope of the A.C. power source.

13. The apparatus recited in claim 10 wherein is included:

a bi-directional current limiting circuit connected in series with the gas discharge lamp, A.C. power source and said ballast capacitor means.

14. The apparatus recited in claim 10 wherein said trigger means comprises a pulse transformer having its secondary winding connected in series with said ballast capacitor means, A.C. power source and gas discharge lamp and wherein is included:

switching means operably connected to the primary of said pulse transformer for producing a current pulse in the primary of said pulse transformer and;

sensing means for actuating said switching means when the instantaneous magnitude of the A.C. power source is sufficient to maintain the lamp operating voltage.

15. The apparatus recited in claim 10 wherein said trigger means comprises at least one capacitor which is connected with said ballast capacitor means, discharge lamp and A.C. power source, so as to provide an additional potential for reigniting the lamp at a time prior to the occurrance of sufficient voltage from the A.C. power source.

* * * * *